US006225893B1

(12) United States Patent
Caissie

(10) Patent No.: US 6,225,893 B1
(45) Date of Patent: May 1, 2001

(54) ALARM SYSTEM FOR ENGINE BLOCK HEATER

(76) Inventor: Laurent Caissie, 1179, Route 310 Coteau Road, New Brunswick (CA), E8T 3K6

( * ) Notice: Subject to any disclaimer, the term of this patent is extended or adjusted under 35 U.S.C. 154(b) by 0 days.

(21) Appl. No.: 09/597,828

(22) Filed: Jun. 19, 2000

Related U.S. Application Data

(63) Continuation-in-part of application No. 09/334,558, filed on Jun. 21, 1999.

(51) Int. Cl.[7] ..... G60Q 1/00
(52) U.S. Cl. ..... 340/438; 340/635; 219/202
(58) Field of Search ..... 340/640, 438, 340/635, 459, 683; 219/202, 205; 237/12.3 C; 307/10.7, 117

(56) References Cited

U.S. PATENT DOCUMENTS

| | | | | |
|---|---|---|---|---|
| 2,037,748 | | 4/1936 | Zahodiakin | 117/311 |
| 2,129,571 | | 9/1938 | Driscoll | 219/38 |
| 2,507,213 | | 5/1950 | McConnell | 219/19 |
| 3,596,265 | | 7/1971 | Garland | 340/280 |
| 3,744,046 | | 7/1973 | Tamasi | 340/253 |
| 3,870,855 | | 3/1975 | Edlund et al. | 219/202 |
| 4,636,775 | * | 1/1987 | Burgess | 340/566 |
| 5,012,070 | | 4/1991 | Reed | 219/202 |
| 5,115,116 | | 5/1992 | Reed | 219/202 |
| 5,204,991 | | 4/1993 | Law | 307/10.7 |
| 5,210,393 | | 5/1993 | Shier | 219/205 |
| 5,675,321 | | 10/1997 | McBride | 340/568 |
| 5,764,469 | * | 6/1998 | Slepian | 361/92 |
| 5,801,618 | | 9/1998 | Jenkins | 340/426 |
| 5,831,244 | * | 11/1998 | Springer | 219/203 |
| 5,994,669 | * | 11/1999 | McCall | 219/209 |

* cited by examiner

*Primary Examiner*—Jeffery Hofsass
*Assistant Examiner*—Anh La
(74) *Attorney, Agent, or Firm*—Mario Theriault

(57) ABSTRACT

An alarm system, for warning an operator of a motor vehicle of an energized block heater condition when an engine is starting, has a housing, a wiring circuit for connection to a warning device and to a power source, and a proximity detector mounted inside the housing and being connected to the circuit for detecting a condition in a block heater cord of a motor vehicle. There is also provided a switch incorporated in or with the proximity detector for operating the warning device upon detecting a condition in the block heater cord. The alarm system also has a hook, a clip or similar arrangement affixed to the housing for holding a block heater cord near the proximity detector. The proximity detector is either a vibration sensor switch for detecting light shivering movements in the block heater cord upon starting of an engine, or a power detector to detect voltage or current in the block heater cord.

20 Claims, 8 Drawing Sheets

ALARM SYSTEM FOR ENGINE BLOCK HEATER

This is a continuation-in-part of U.S. patent application Ser. No. 09/334,558, filed on Jun. 21, 1999

FIELD OF THE INVENTION

The present invention relates to vehicle alarm systems, and more particularly it relates to an alarm system to warn a motor vehicle operator of a vehicle starting condition, and more commonly, of an energized engine block heater condition.

BACKGROUND OF THE INVENTION

Distrait motor vehicle operators can forget to unplug an extension cord to the block heater of their vehicles before driving away. When this happens and the cord leading to the block heater is tied to the grille of the vehicle, damage to the grille can occur. In other instances, the extension cord can be lost at some distance from the operator's home, when it finally let go from the block heater cord. It is therefore desirable to warn a motor vehicle operator of such inadvertence before, or as soon as the vehicle's engine is started.

Engine block heater of the conventional type are described in U.S. Pat. No. 2,507,213 issued on May 9, 1950 to Roy H. McConnell, and in U.S. Pat. No. 5,210,393 issued on May 11, 1993 to Richard K. Shier. Each of these devices typically comprises an electrical heating element mounted to the engine block and extending into one of the cooling fluid passage of the engine block. An electrical cord is connected to the terminals of the electrical heating element, and extends from under the hood of the engine compartment for connection to a common electrical extension cord. These devices, however, are lacking a means for connection to an annunciator system of a vehicle, or to an alarm device to remind an operator to unplug the extension cord before starting the engine.

In other electrical circuits of vehicles, pilot lights are used to indicate to an operator when an engine warming device is in operation. Examples of these circuits are illustrated in the U.S. Pat. No. 2,129,571 issued on Sep. 6, 1938 to Joseph Driscoll, and in the U.S. Pat. No. 3,744,046 issued on Jul. 3, 1973 to Nick J. Tamasi. In the first case, the pilot light indicates an "ON" mode of a carburetor heater, and in the latter case, a series of indicator lights shows various operating conditions of an auxiliary heater for a diesel engine. In both cases, however, it is believed that the installations are complex and better done by an experienced auto-mechanic. Also, these circuits do not have any means to warn an operator of an energized block heater condition when an engine is started.

The unavailability of an alarm system for use in association with an engine block heater has contributed to the development of a market demand for a simple alarm system that is compatible to most vehicle configurations and that is susceptible of easy installation by a person having few tools and limited electrical and mechanical skills.

SUMMARY OF THE INVENTION

In the present invention, there is provided an alarm system which is manufacturable at low cost and which is easily installed in the engine compartment of a vehicle. The alarm system of the present invention is manufacturable as a single alarm system kit that fits most makes and types of motor vehicles. For these reasons, the alarm system of the present invention is appropriate for sale to the public through general hardware stores and large commodity store chains for examples.

Broadly, in accordance with one aspect of the present invention, there is provided an alarm system which comprises a housing, a wiring circuit for connection to a warning device and to a power source. There is also provided a proximity detector mounted inside the housing and connected to the circuit for detecting a condition in a block heater cord of a motor vehicle. A transistor, a SCR, a relay or other switching means is incorporated in or with the proximity detector for selectively operating the warning device upon detecting a condition in the block heater cord. The alarm system also has a hook, a clip or similar arrangement affixed to the housing for holding a block heater cord near the proximity detector. The proximity detector is either a vibration switch for detecting light shivering movements in the block heater cord upon starting of an engine, or a power detector to detect voltage or current in the block heater cord.

A principal advantage of the alarm system of the present invention is that the warning device is operable to warn a vehicle operator when an electrical power source is connected to an engine block heater when the engine is starting. The warning device is thereby usable to remind an operator of a vehicle to unplug the electrical power source before moving the vehicle.

Another advantage of the alarm system is that condition in the block heater cord is detected without connection to the AC power inside the cord. Because of this arrangement, the alarm system does not require the safety tests and certifications which are normally associated with electrical appliances.

In another aspect of the present invention, the alarm system further comprises a power-on module connected to the circuit and to the warning device. The power-on module causes the warning device to emit a first signal upon energizing the circuit, to confirm that the engine block heater is properly energized.

In yet another aspect of the present invention, the alarm system also comprises a power-off module connected to the circuit and to the warning device. The power-off module causes the warning device to emit a second signal upon de-energizing the circuit, to confirm that the block heater has been properly energized.

Still another feature of the invention is that it is susceptible of a low cost of manufacture with regard to materials, equipment and labour, and which accordingly is then susceptible of low price of sale to the consumer, thereby making such alarm system economically available to the public.

BRIEF DESCRIPTION OF THE DRAWINGS

Three embodiments of this invention are illustrated in the accompanying drawings, in which like numerals denote like parts throughout the several views, and in which.

DETAILED DESCRIPTION OF THE PREFERRED EMBODIMENT

Figure 1:
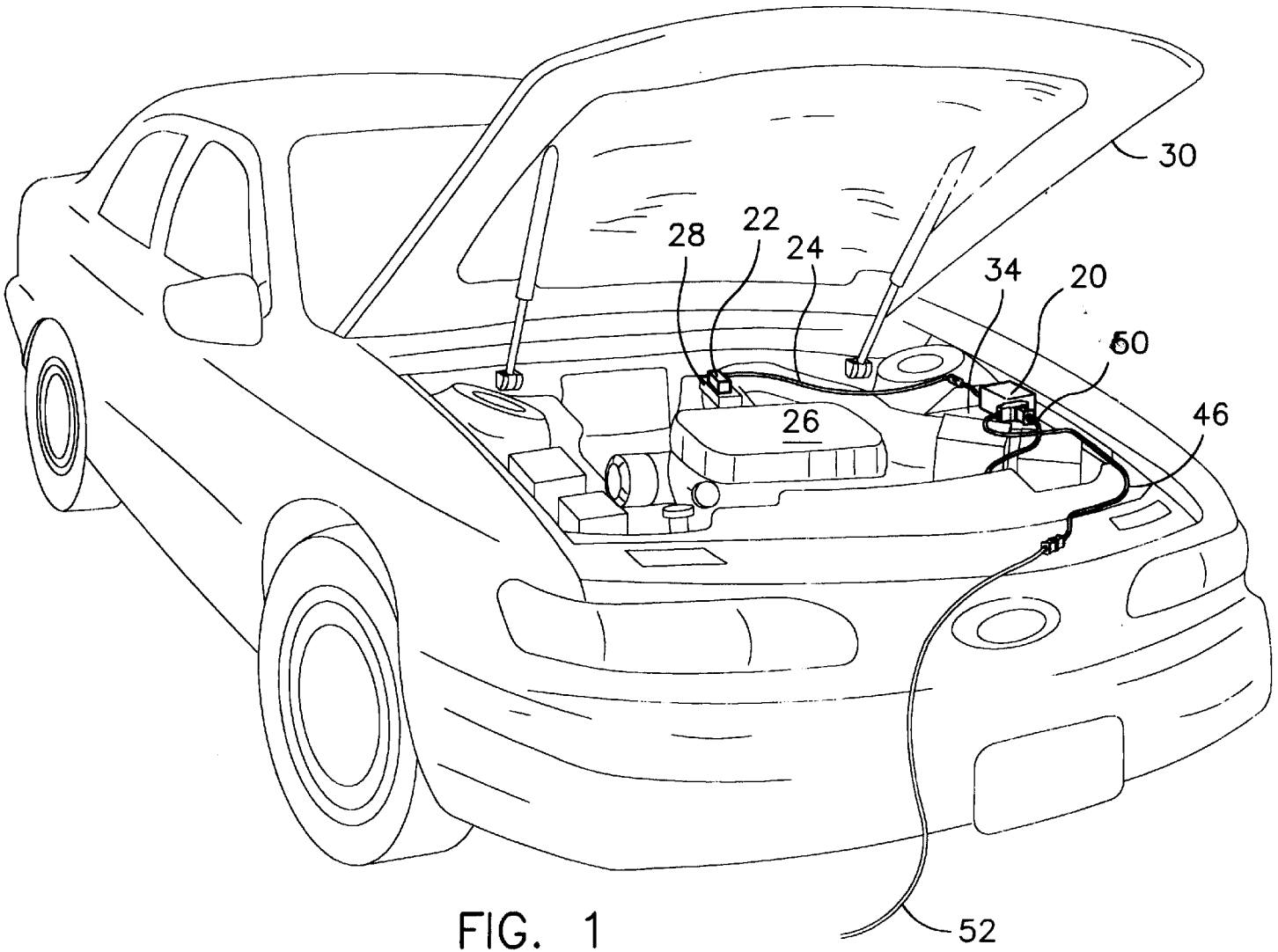
FIG. 1 is front view of the engine compartment of a vehicle, and a preferred installation of the alarm system according to the first preferred embodiment of the present invention.

While this invention is susceptible of embodiments in many various forms, there are shown in the drawings and will be described in details herein three specific embodiments of the present invention, with the understanding that the present disclosure is to be considered as an example of the principles of the invention and is not intended to limit the invention to the embodiments illustrated.

Figures 2, 3:
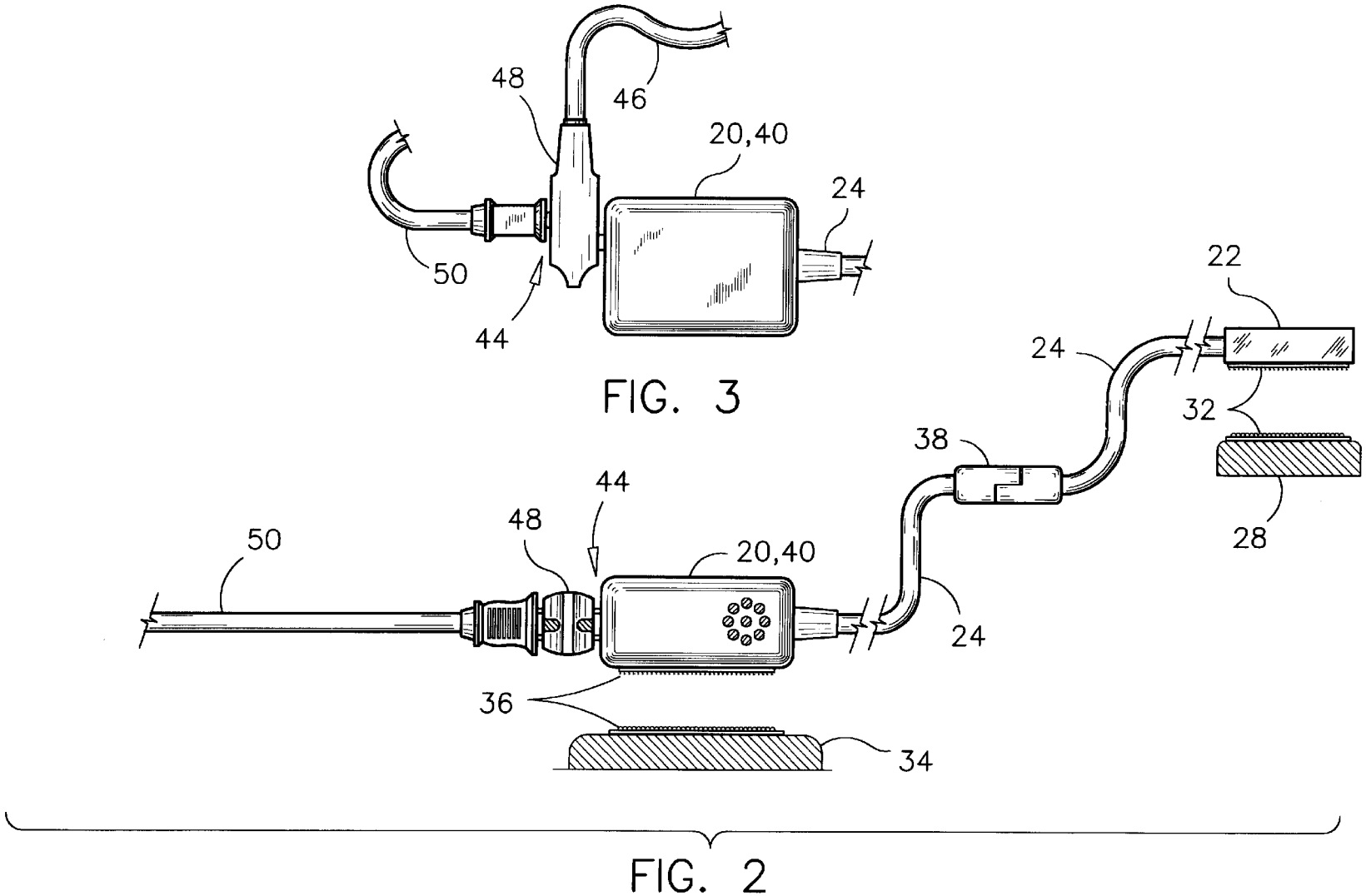
FIG. 2 is a partial side view of the alarm system according to the first preferred embodiment.
FIG. 3 is a partial top view of the alarm system shown in FIG. 2.

Referring to FIGS. 1–3, the alarm system according to the first preferred embodiment and a preferred installation thereof in a vehicle are illustrated in these drawings. The alarm system according to the first preferred embodiment is sold as a kit for installation by a vehicle owner. The alarm system comprises basically a circuit module 20, a vibration sensor switch 22, and a first electrical cord 24 connecting the vibration sensor switch 22 to the circuit module 20.

In a preferred installation, the vibration sensor switch 22 is mounted to the engine 26 of a vehicle, to detect a movement of the engine upon starting. The vibration sensor switch 22 is preferably mounted to an engine accessory 28 that does not get hot, and that stays relatively clean, such as an alternator support bracket, an intake air filter housing, or a similar part where the safe and proper operation of the engine 26 and of the engine compartment's hood 30 are not affected. The vibration sensor switch 22 is preferably held to that accessory 28 by a first pair of Velcro™ fasteners 32.

The circuit module 20 is preferably affixed to the vehicle's fender, to the wheel well housing or other fixed portion 34 of the vehicle inside the engine compartment, by means of a second pair of Velcro™ fasteners 36. The alarm module 20 and the first cord 24 are also preferably installed in locations where their presences do not hinder a safe and efficient operation of the engine 26 of the vehicle and of the engine compartment's hood 30.

The use of Velcro™ fasteners is advantageous for allowing an installation of the alarm system kit without tools per se. The alarm system kit is installable by a person having essentially a wiping cloth to clean the surfaces on which the vibration sensor switch 22 and the circuit module 20 are to be mounted, and if desired a few plastic cable ties or clips to secure the first cord 24 to an engine compartment accessory.

The first cord 24 preferably has a releasable connector 38 at an intermediate region thereof to facilitate the installation of the circuit module 20 and of the vibration sensor switch 22.

It will be appreciated that although Velcro™ fasteners are mentioned above, other equivalent fasteners can also be used to obtain the above-mentioned advantages. For examples, one manufacturer may find it more appropriate to provide the alarm system kit with double-sided adhesive tape, with a glue kit, or with mounting eyelets on the switch and on the module's housing.

Figure 4:
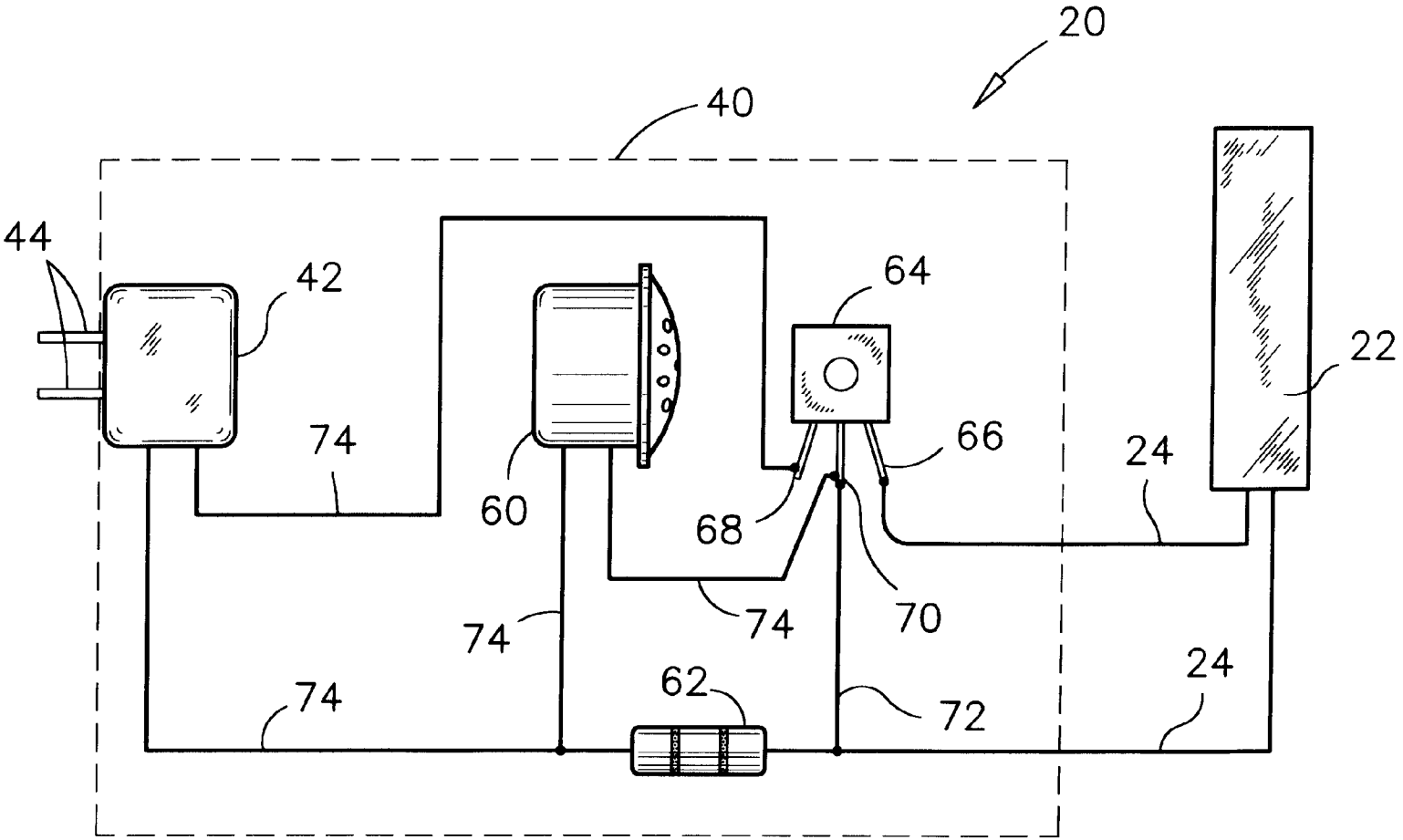
FIG. 4 is a schematic illustration of the circuit inside the circuit module of the alarm system according to the first preferred embodiment.
Figure 5:
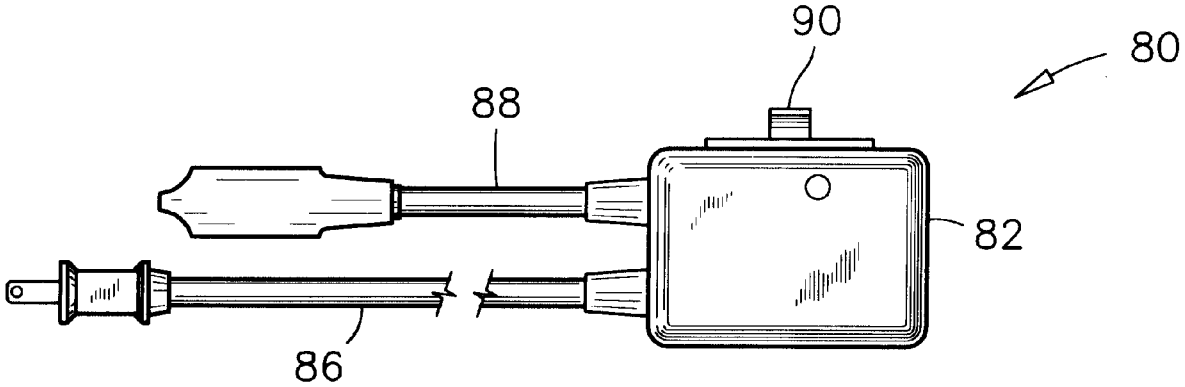
FIG. 5 is a top view of the circuit module of the alarm system according to the second preferred embodiment.
Figure 7:
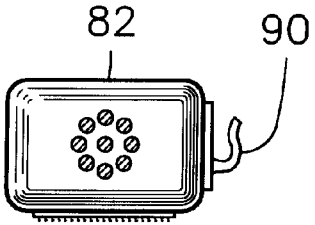
FIG. 7 is an end view of the circuit module of the alarm system according to the second preferred embodiment.

Referring now to FIGS. 2, 3 and 4, the circuit module 20 and the entire alarm system according to the first preferred embodiment will be explained in details. Firstly, the circuit module 20 comprises a sealed housing, shown in dashed lines in FIG. 4, and labelled as numeral 40. A transformer/rectifier 42 is enclosed inside the housing 40, and has input prongs 44 protruding through the housing 40.

In use, an intermediate electrical extension cord 46 with a multiple-parallel-outlet end 48 is connected to the inlet prong 44 of the transformer/rectifier 42, to supply electrical power to the transformer/rectifier 42. The block heater cord 50 is also connected to the multiple-parallel-outlet end 48, to supply electrical power to the engine block heater (not shown). Although this intermediate electrical extension cord 46 is optional as one can understand, it is recommended that such cord 46 be provided in an alarm system kit mountable in various makes and types of vehicles. The use of this intermediate cord 46 allows the installation of the circuit module 20 at various locations in an engine compartment, and allows the connection of the circuit module 20 to a main electrical cord 52 without having to open the hood of the vehicle at each time. The length of the intermediate cord 46 is preferably about four to six feet to facilitate the installation of the circuit module 20 almost anywhere in the engine compartment.

The circuit module 20 also comprises a buzzer 60, a resistor 62 and a silicon-controlled rectifier (SCR) 64. A vibration from the engine 26 momentarily closes a pair of contacts inside the vibration sensor switch 22 and establishes a voltage across the gate terminal 66 and the cathode terminal 68 of the SCR 64. This voltage turns the SCR "ON" allowing current to flow from the anode 70 to the cathode 68 thereby allowing a current through the buzzer 60. The sound of the buzzer 60 warns a vehicle operator of the presence of an AC power source connected to the vehicle and urges the operator to disconnect the main electrical extension cord 52 from the intermediate electrical extension cord 46 to shut the buzzer "OFF".

The resistor 62 is selected to ensure a minimum anode-to-cathode holding current through the SCR 64, through the conductor 72. It will be appreciated that the use of a resistor 62 and the conductor 72 may not be required when the buzzer 60 is replaced by a warning device that has continuous current carrying characteristics.

Other wiring structure inside the circuit module 40, generally illustrated as numeral 74, is made of individual wires, or of conductors printed on a circuit board, according to the preferences of a manufacturer.

The transformer/rectifier is preferably a type having means for reducing a voltage from 120 volts AC to 12 volts DC. The vibration switch 22, the buzzer 60, and the SCR 64 are also selected to operate on 12 volts DC, such that the alarm system is compatible to regulations governing the manufacturing and sale of automotive accessories. The size of the resistor 62 is selected according to the characteristics of the SCR 64, and especially to the minimum anode-to-cathode holding current required to maintain the SCR 64 in an "ON" mode.

Referring now to FIGS. 5–9, there will be described the alarm system 80 according to the second preferred embodiment of the present invention. The alarm system 80 according to the second preferred embodiment differs from the alarm system 20 according to the first preferred embodiment, basically, in that the vibration sensor switch 22 is mounted inside the housing 82 of the alarm module, and that the transformer/rectifier 42 is completely enclosed inside the housing 82. The transformer/rectifier is connected to a terminal strip 84. Electrical power to the alarm system 80 is supplied through an inlet cord 86 and electrical power to the engine block heater (not shown) is supplied through an outlet cord 88. Both the inlet and outlet cords 86, 88 are connected in parallel to each other and to the terminal strip 84.

An important aspect of this second embodiment is that the electrical cord 50 to the engine block heater is held to the housing 82 of the alarm module by means of a hook 90 affixed to the housing 82. The movements of the engine upon starting are transmitted to the electrical cord 50 and cause the cord to shake lightly and shiver. These vibrations are transmitted to the housing 82 via the hook 90. The cord movements are sensed by the vibration sensor switch 22 to energize the alarm circuit as it was previously explained and to warn the operator of the block heater condition.

For this purpose, the vibration sensor switch 22 preferably comprises a sensitivity adjustment device 92 therein, such that this proximity detection arrangement of the alarm system is adaptable to vehicles of different configurations and to block heater cords that are more or less taut.

Figure 8:
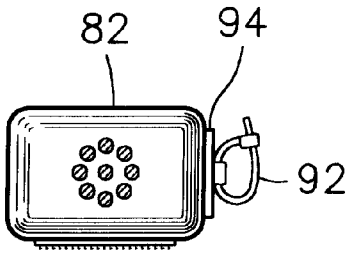
FIG. 8 is an end view of the circuit module shown in FIG. 7, showing a cable tie for alternatively retaining the engine block heater cord to the circuit module.
Figure 6:
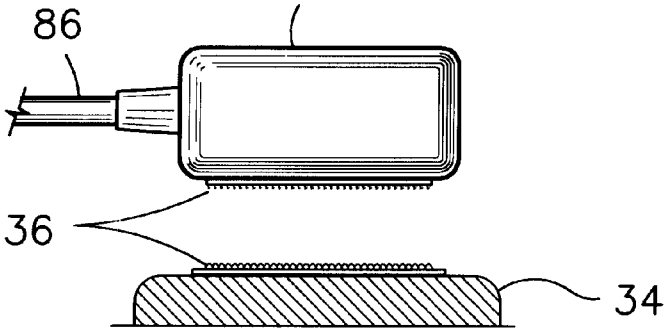
FIG. 6 is a side view of circuit module of the alarm system according to the second preferred embodiment.
Figure 9:
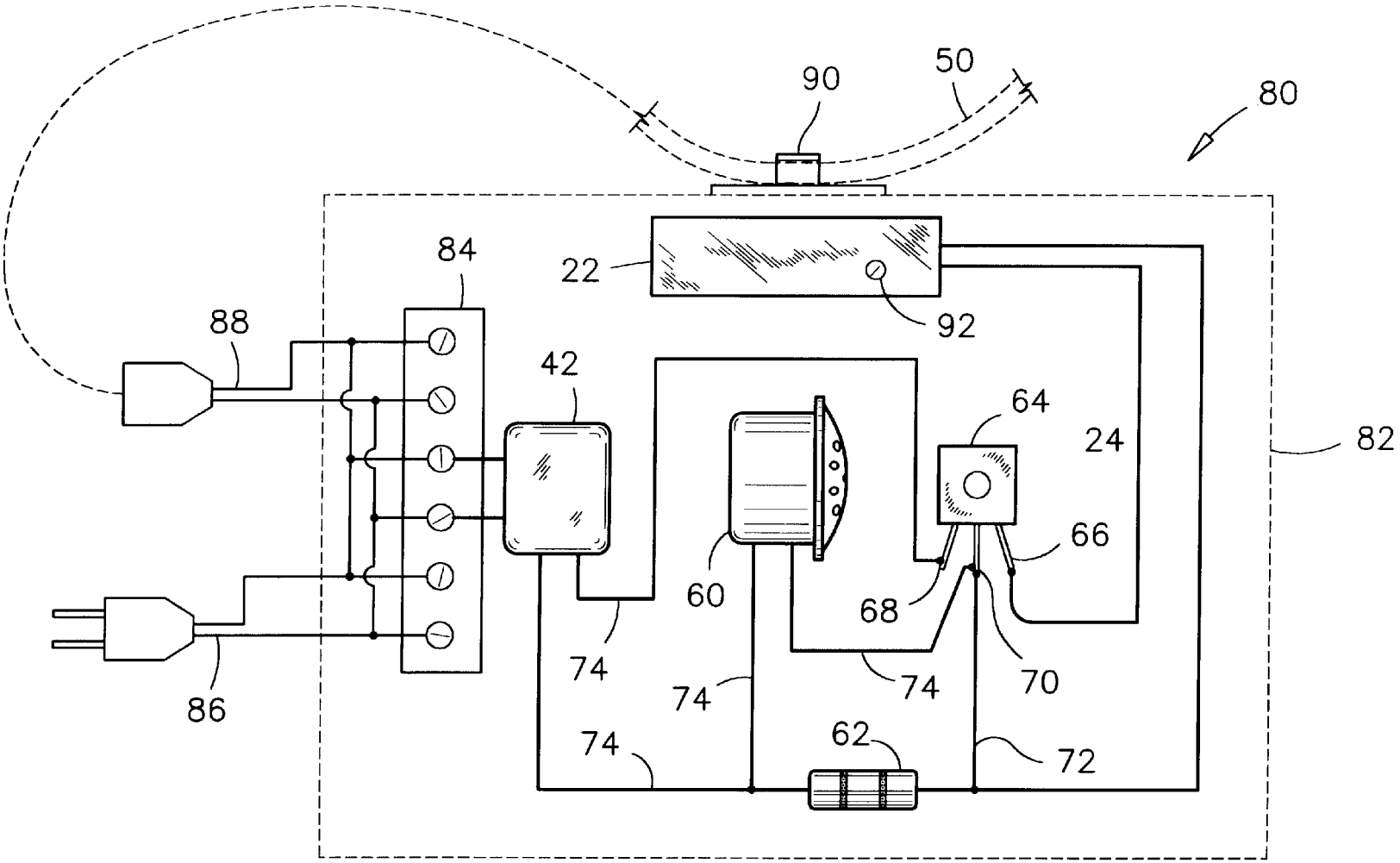
FIG. 9 is a schematic illustration of the circuit inside the circuit module of the alarm system according to the second preferred embodiment.

Although a hook 90 is shown, the block heater cord 50 may be held to the housing 82 of the alarm module by various other means, one of which is a plastic cable tie 92, and a common adhesive-backing-type wire holder 94, as illustrated in FIG. 8.

Figure 10:
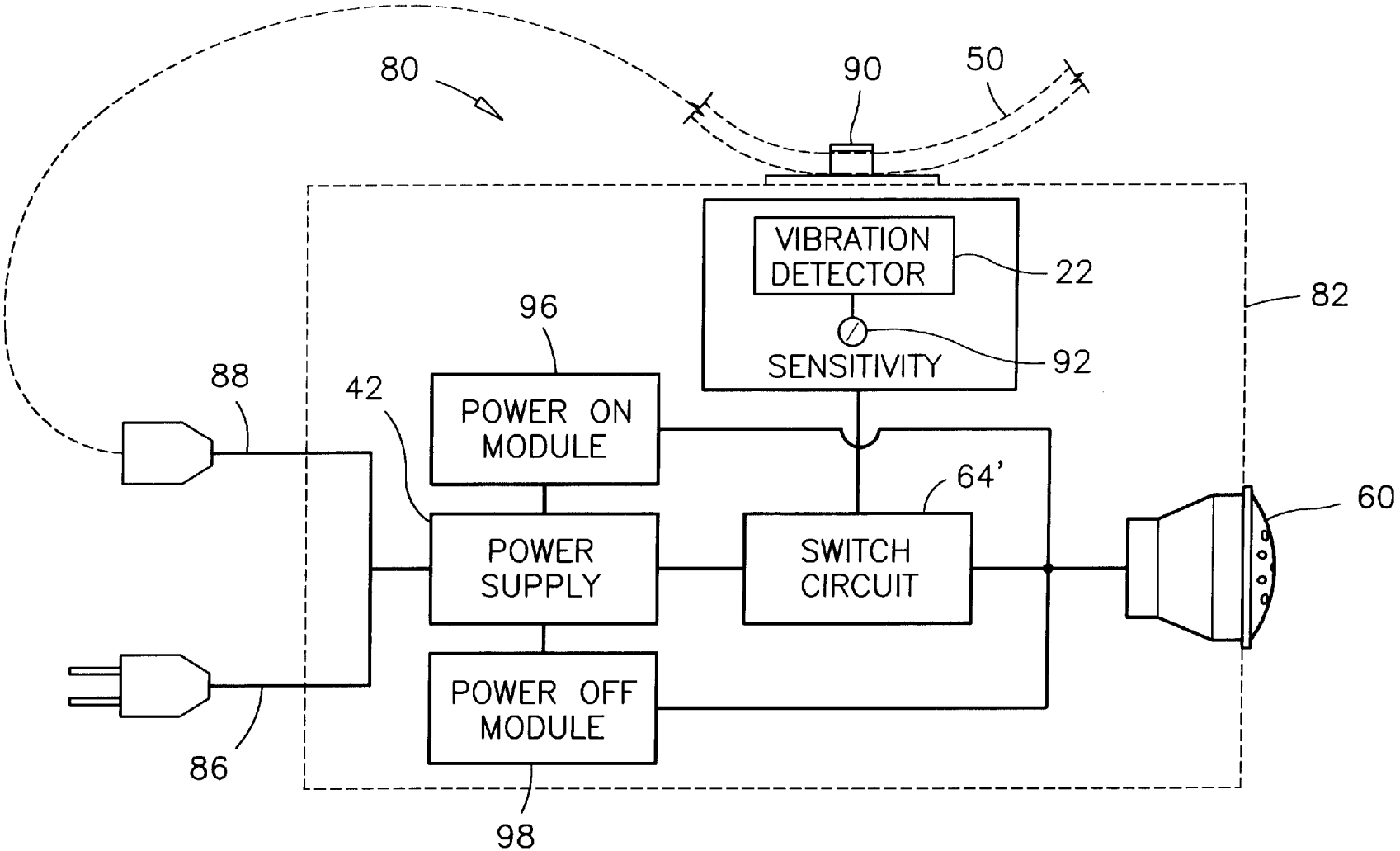
FIG. 10 is a schematic illustration of the circuit of the alarm system according to the second preferred embodiment showing optional circuits therein.

Several optional features are available for incorporation in the alarm system 80 according to the second preferred embodiment and are shown schematically in FIG. 10. These options comprise a power-on module 96 and a power-off module 98. The circuits of these modules comprise timers, relays and capacitors. The function of the power-on module 96 is to emit a first signal, such as two short "beeps" when the inlet cord 86 is being energized. The function of the power-off module 98 is to emit a second signal, such as a "single beep with decreasing intensity" when the inlet cord 86 is being de-energized. The power-on and power-off modules are advantageous for confirming that the engine block heater is or has been energized.

The alarm system according to the second preferred embodiment 80 also comprises a switch circuit 64' which is similar to or exactly the same as the switch circuit 64, 66, 68, 70 in the first preferred embodiment 20.

Figure 11:
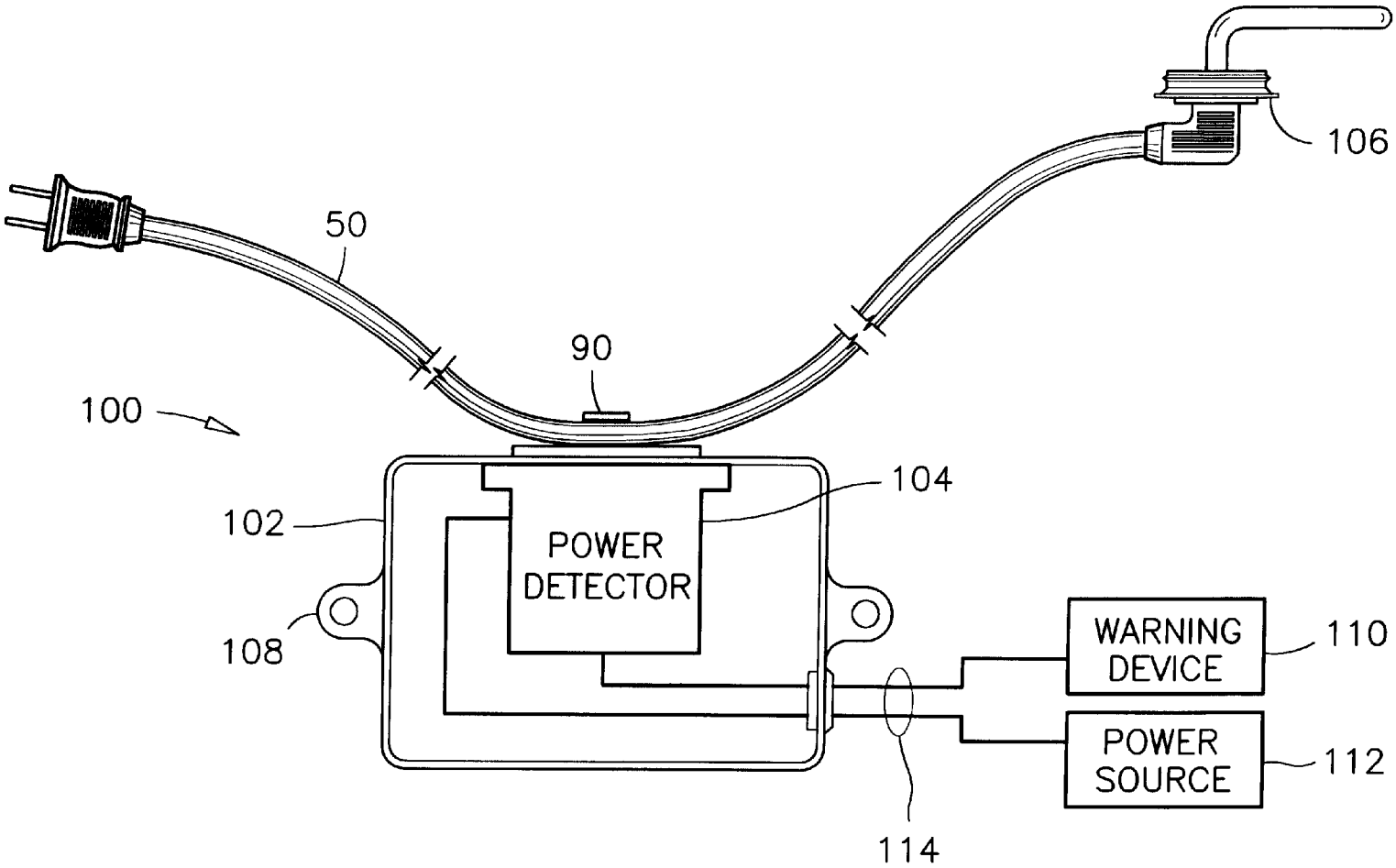
FIG. 11 is a schematic illustration of the circuit of the alarm system according to the third preferred embodiment.
Figure 12:
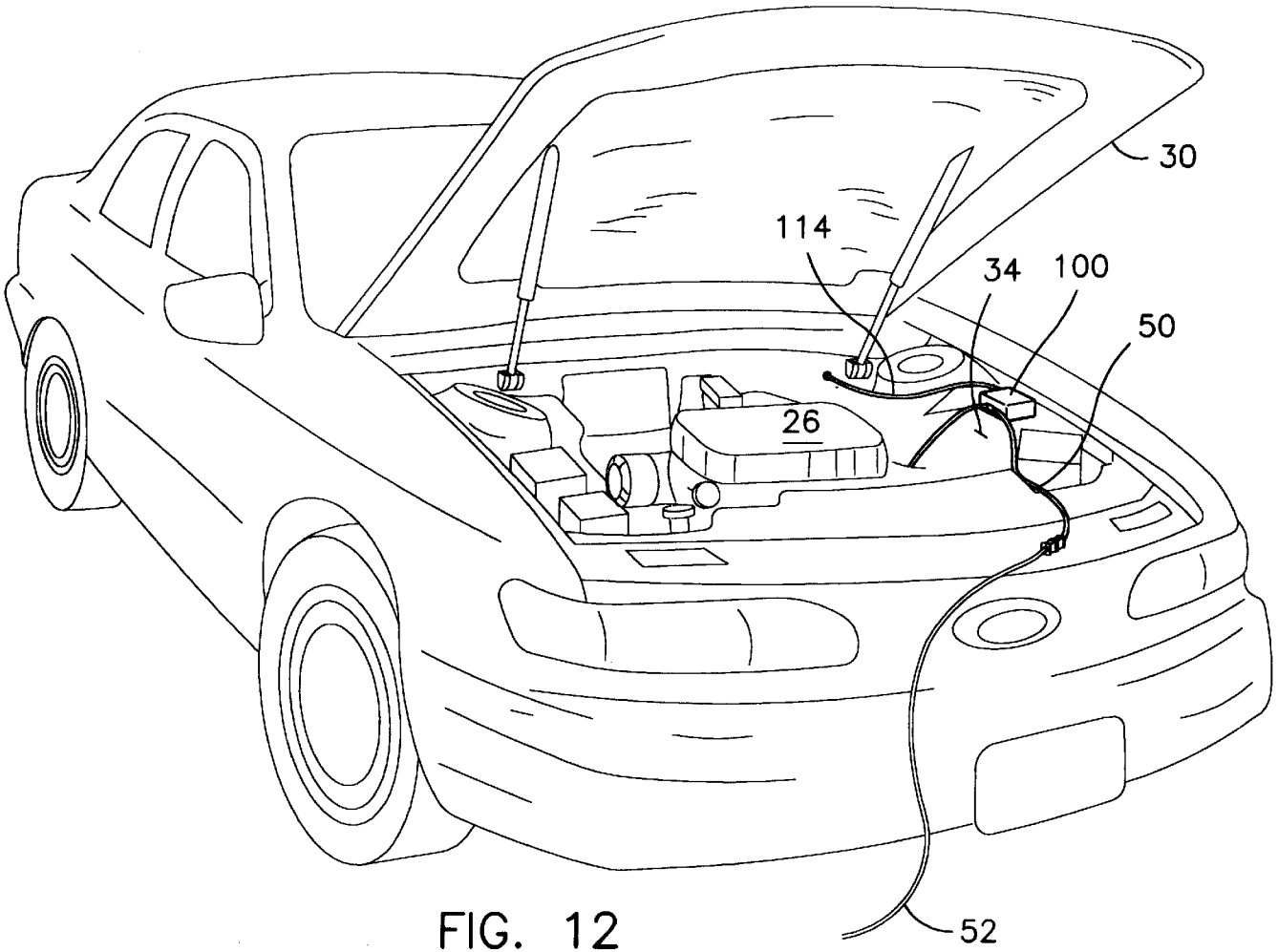
FIG. 12 is front view of the engine compartment of a vehicle, and a preferred installation of the alarm system according to the third preferred embodiment of the present invention.

Referring now to FIGS. 11 and 12, there is illustrated therein the third preferred embodiment of the present invention. This third preferred embodiment 100 comprises a housing 102 and a power detector 104 mounted inside the housing to detect the presence of electric power in the block heater cord 50. The electrical cord 50 to the engine block heater 106 is also held near the housing 102 of the alarm module by means of a hook 90 for example affixed to the housing 102. The power detector 104 is a proximity-type detector with a built-in switch means for operating a warning device upon detecting electrical power in the block heater cord. Such power detectors are known commercially as non-contact voltage detectors or induction-type current detectors.

This third preferred embodiment 100 of the alarm system can be mounted as a standard feature in new vehicles or as a retrofit unit in used vehicles. Mounting eyelets 108 are provided and are usable with fasteners to permanently affix the alarm module to the engine compartment of the vehicle. In this installation, the warning device 110 is preferably a bell or a buzzer mountable in the passenger compartment of the vehicle, or a light or other visual means such as a readable message on a liquid crystal display on the dashboard of the vehicle. Similarly, the power source 112 to the alarm system is preferably provided by the vehicle's electrical system.

The power source 112 may contain a signal from the ignition of the vehicle to operate the warning device 110 only when the engine is being started. The power source 112 can also be a continuous source of power. In this latter case, the alarm system has a dormant mode where a single dashboard light indicates an energized block heater condition. In this latter case, the electrical components of the alarm system 100 are selected such that the total power consumption of the alarm system is comparable to the clock of the vehicle, and that the battery of the vehicle is not affected by the continuous operation of the alarm system 100.

The electrical wiring to the warning device 110 and from the vehicle's electrical power system 112 consists of a single multi-conductor cable 114 which is connected to or routed along the wiring harness of the vehicle.

It will be appreciated that the power-on and power-off options 96, 98 of the alarm system 80 according to the second preferred embodiment are installable in the alarm systems of the first and third preferred embodiments. The buzzer 60 incorporated in the alarm modules of the first or second preferred embodiment is installable in the housing 102 of the alarm system of the third preferred embodiment and is usable in addition to the dashboard alarm 110, to warn an operator standing in front of the vehicle for example upon plugging or unplugging the main extension cord 52. The non-contact power detector 104 of the third preferred embodiment is also installable in the second preferred embodiment in replacement of the vibration detector 22. Similarly, the housing 102 of the alarm system according to the third preferred embodiment is mountable to the vehicle's fender or wheel well with Velcro™ fasteners instead of the eyelets 108.

As to additional details related to the manufacturing, installation and operation of the present invention, the same should be apparent from the above description and accompanying drawings, and accordingly further discussion relative to the manner of making, installing and using the alarm system of the first preferred embodiment would be considered repetitious and is not provided.

While three embodiments of the present invention and preferred installations thereof have been illustrated and described herein above, it will be appreciated by those skilled in the art of electronics and auto-mechanics that various modifications, alternate constructions, alternate mounting arrangements and equivalents may be employed without departing from the true spirit and scope of the invention. Therefore, it will be appreciated that the above description and illustrations should not be construed as limiting the scope of the invention which is defined by the appended claims.

I claim:

1. An alarm system for detecting and warning an operator of a motor vehicle of a vehicle starting condition, comprising:

a circuit having means for connection to a warning device and to a power source;

a proximity detector connected to said circuit and having means to detect a condition in a block heater cord of a motor vehicle without electrically connecting to said block heater cord, and means, connected to said circuit, to selectively operate said warning device upon detecting said condition; and means for holding a block heater cord near said proximity detector;

such that a condition in a block heater cord of a motor vehicle is detectable thereby without drawing power from said block heater cord, and a warning device is operable to timely warn an operator of said motor vehicle relative to said condition.

2. The alarm system as claimed in claim 1, further comprising a housing and wherein said proximity detector is mounted in said housing.

3. The alarm system as claimed in claim 2, wherein said housing comprises means for retention thereof in an engine compartment of a motor vehicle.

4. The alarm system as claimed in claim 2, wherein said means for holding a block heater cord near said proximity detector is a hook affixed to said housing.

5. The alarm system as claimed in claim 4, wherein said condition in a block heater cord is a movement in said cord and said proximity detector is a vibration sensor switch.

6. The alarm system as claimed in claim 5, wherein said vibration sensor switch comprises a sensitivity adjustment means.

7. The alarm system as claimed in claim 1, wherein said condition in a block heater cord is electrical power and said proximity detector is a non-contact voltage detector.

8. The alarm system as claimed in claim 1, wherein said power source is 12 volt DC and said block heater cord carries 120 volt AC, and said block heater cord is electrically independent from said circuit and said power source.

9. The alarm system as claimed in claim 1, wherein said means for connection to a warning device and to a power source comprises means for connection to a visual indicator in a dashboard of a motor vehicle.

10. The alarm system as claimed in claim 2, wherein said warning device is mounted in said housing and is connected to said circuit.

11. The alarm system as claimed in claim 10, further comprising a power-on module connected to said circuit and having means for operating said warning device upon energizing said circuit.

12. The alarm system as claimed in claim 11, further comprising a power-off module connected to said circuit and having means for operating said warning device upon de-energizing said circuit.

13. The alarm system as claimed in claim 1, wherein said means for connection to a warning device and to a power source comprises means for connection to an AC power extension cord.

14. The alarm system as claimed in claim 3, wherein said means for retention thereof in an engine compartment of a motor vehicle comprise Velcro™ fasteners.

15. An alarm system for detecting and warning an operator of a motor vehicle of a vehicle starting condition, said alarm system comprising:

an alarm module having a housing and a circuit mounted in said housing;

a power source connected to said circuit for operating said circuit;

a warning device connected to said circuit and being operable by said circuit;

a proximity detector mounted inside said housing and connected to said circuit, and having means for detecting a condition in a block heater cord through said housing and without electrically connecting to said block heater cord;

switch means connected to said circuit and having means for operating said warning device upon receiving a signal from said proximity detector;

means affixed to said housing for holding a block heater cord near said housing and near said proximity detector; and means for retaining said housing in an engine compartment of a vehicle;

such that a condition in a block heater cord of a motor vehicle is detectable by said proximity detector without drawing power from said block heater cord, and said warning device is operable to timely warn an operator of said motor vehicle relative said block heater condition.

16. The alarm system as claimed in claim 15, wherein said condition in a block heater cord is a movement in said block heater cord and said proximity detector is a vibration sensor switch.

17. The alarm system as claimed in claim 16, wherein said vibration sensor switch comprises a sensitivity adjustment means.

18. The alarm system as claimed in claim 15 wherein said condition in a block heater cord is a voltage and said proximity detector is a non-contact voltage detector.

19. In combination, an engine block heater cord carrying AC electric power and an alarm system for detecting and warning an operator of a motor vehicle of said AC electric power in said engine block heater cord; said alarm system comprising:

a circuit connected to a DC electric power source and to a warning device;

a power detector connected to said circuit and having means to detect said AC electric power in said engine block heater cord without electrically connecting to said engine block heater cord;

means for holding said block heater cord near said power detector, and means, connected to said circuit, to selectively operate said warning device upon detecting said AC electric power in said engine block heater cord;

such that said alarm system is electrically independent from said engine block heater cord.

20. The combination as claimed in claim 19, wherein said alarm system further comprises a power-on module connected to said circuit and having means for operating said warning device when said circuit is being energized and a power-off module connected to said circuit and having means for operating said warning device when said circuit is being de-energized.

* * * * *